US010410600B2

(12) United States Patent
Lian et al.

(10) Patent No.: US 10,410,600 B2
(45) Date of Patent: Sep. 10, 2019

(54) DISPLAY PANEL

(71) Applicant: AU OPTRONICS CORPORATION, Hsin-chu (TW)

(72) Inventors: Shiang-Lin Lian, Hsin-chu (TW); Mei-Yi Li, Hsin-chu (TW); Yu-Chieh Kuo, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 8 days.

(21) Appl. No.: 15/962,476

(22) Filed: Apr. 25, 2018

(65) Prior Publication Data

US 2018/0330690 A1 Nov. 15, 2018

(30) Foreign Application Priority Data

May 10, 2017 (TW) ..... 106115490 A

(51) Int. Cl.
*G09G 3/36* (2006.01)
*G09G 3/20* (2006.01)

(52) U.S. Cl.
CPC ..... *G09G 3/3688* (2013.01); *G09G 3/20* (2013.01); *G09G 3/3655* (2013.01); (Continued)

(58) Field of Classification Search
CPC ..... G09G 3/20; G09G 3/3655; G09G 3/3688; G09G 2310/0267; G09G 2310/0275; G09G 2320/0223
See application file for complete search history.

(56) References Cited

U.S. PATENT DOCUMENTS 10,324,319 B2 * 6/2019 Lee ..... G02F 1/13306
2002/0130829 A1 9/2002 Ilda et al.
(Continued)

FOREIGN PATENT DOCUMENTS

TW 200423011 A 11/2004
TW I250339 B 3/2006
(Continued)

OTHER PUBLICATIONS

Office Action issued by (TIPO) Intellectual Property Office, Ministry of Economic Affairs, R. O. C. dated May 7, 2018 for Application No. 106115490, Taiwan.

*Primary Examiner* — Nelson M Rosario
(74) *Attorney, Agent, or Firm* — Tim Tingkang Xia, Esq.; Locke Lord LLP

(57) ABSTRACT

A display panel includes a signal generating circuit, a pixel array disposed adjacent to the signal generating circuit, and a plurality of gate driver circuits disposed adjacent to the signal generating circuit and the pixel array. The signal generating circuit is configured to provide a plurality of clock signals and a plurality of data signals. The gate driver circuits are configured to convert the clock signals to a plurality of gate signals and transfer the gate signals to the pixel array. The pixel array is configured to receive the gate signals and the data signals for display. Delays of the gate signals increase along a first direction, delays of the data signals increase along a second direction, and the second direction is opposite to the first direction. The signal generating circuit is further configured to calibrate the gate signals and the data signals.

10 Claims, 4 Drawing Sheets

(52) U.S. Cl.
CPC ..... *G09G 2310/0267* (2013.01); *G09G 2310/0275* (2013.01); *G09G 2320/0223* (2013.01)

(56) References Cited

U.S. PATENT DOCUMENTS

| | | | | |
|---|---|---|---|---|
| 2004/0222981 | A1 | 11/2004 | Kobayashi et al. | |
| 2010/0327955 | A1 | 12/2010 | Umezaki | |
| 2015/0145852 | A1* | 5/2015 | Ahn | G09G 3/3677 345/214 |

FOREIGN PATENT DOCUMENTS

| | | | |
|---|---|---|---|
| TW | 201539408 | A | 10/2015 |
| TW | 201643850 | A | 12/2016 |

* cited by examiner

DISPLAY PANEL

CROSS-REFERENCE TO RELATED PATENT APPLICATION

This non-provisional application claims priority to and the benefit of, pursuant to 35 U.S.C. § 119(a), patent application Serial No. 106115490 filed in Taiwan on May 10, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present disclosure relates to a display technology, and in particular, to a display panel.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a display panel, a circuit providing a gate signal and a circuit providing a data signal are generally located on one side of a panel display area. However, due to a resistor-capacitor delay generated by transmitting the gate signal on a bus line and transmitting the data signal on a data line, a gate signal and a data signal of which waveforms are severely distorted both occur at a panel display area close to a side opposite to the circuits, causing a problem of incorrect charging of pixels. Moreover, because the waveforms of the gate signal and the data signal are distorted, and both image quality and a charging problem at each position of the display panel need to be considered, it is more difficult to implement accurate calibration.

SUMMARY

An aspect of the present disclosure provides a display panel. The display panel includes a signal generating circuit, a pixel array, and a plurality of gate driver circuits. The pixel array is disposed adjacent to the signal generating circuit, and the plurality of gate driver circuits is disposed adjacent to the signal generating circuit and the pixel array. The signal generating circuit is configured to provide a plurality of clock signals and a plurality of data signals. The gate driver circuits are configured to convert the clock signals to a plurality of gate signals and transfer the gate signals to the pixel array. The pixel array is configured to receive the gate signals and the data signals for display. Delays of the gate signals increase along a first direction, delays of the data signals increase along a second direction, and the second direction is opposite to the first direction. The signal generating circuit is further configured to calibrate the gate signals and the data signals.

Another aspect of the present disclosure provides a display panel. The display panel has a first side edge and a second side edge, where the first side edge is opposite to the second side edge. The display panel includes a data signal generating circuit, a gate signal generating circuit, and a pixel array. The data signal generating circuit is disposed along the first side edge, the gate signal generating circuit is disposed along the second side edge, and the pixel array is disposed between the data signal generating circuit and the gate signal generating circuit. The data signal generating circuit is configured to provide a plurality of data signals. The gate signal generating circuit is configured to provide a plurality of gate signals. The pixel array is configured to receive the gate signals and the data signals for display. Delays of the gate signals increase along a first direction, delays of the data signals increase along a second direction, the second direction is opposite to the first direction, and the first direction and the second direction are perpendicular to the first side edge and the second side edge. The gate signal generating circuit is further configured to calibrate the gate signals and the data signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

The following disclosure provides many different embodiments or examples for implementing features of the present invention. The present disclosure may repeatedly use numerical symbols and/or letters in different examples. Such repetitions are all for simplification and description, and do not specify relationships between different embodiments and/or configurations in the following discussion.

In the embodiments and claims, unless the articles are specifically limited in this specification, "one" and "the" may refer to a single one or a plurality. It should be further understood that "comprise", "include", "have" and similar words used in this specification specify a recorded feature, area, integer, step, operation, element and/or component, but do not exclude the described or additional one or more other features, areas, integers, steps, operations, elements, components, and/or groups thereof.

When an element is described as being "connected" or "coupled" to another element, the element may be directly connected or coupled to the another element, or an additional element may exist. In contrast, when an element is described as being "directly connected" or "directly coupled" to another element, no additional element exists.

"About", "around", or "approximately" used in this specification generally refers to a deviation or range of a value within 20%, preferably within 10%, and more preferably within 5%. Unless otherwise explicitly stated, a value mentioned in this specification is considered as an approximate value, that is, the deviation or range indicated by "about", "around", or "approximately".

Figure 1:
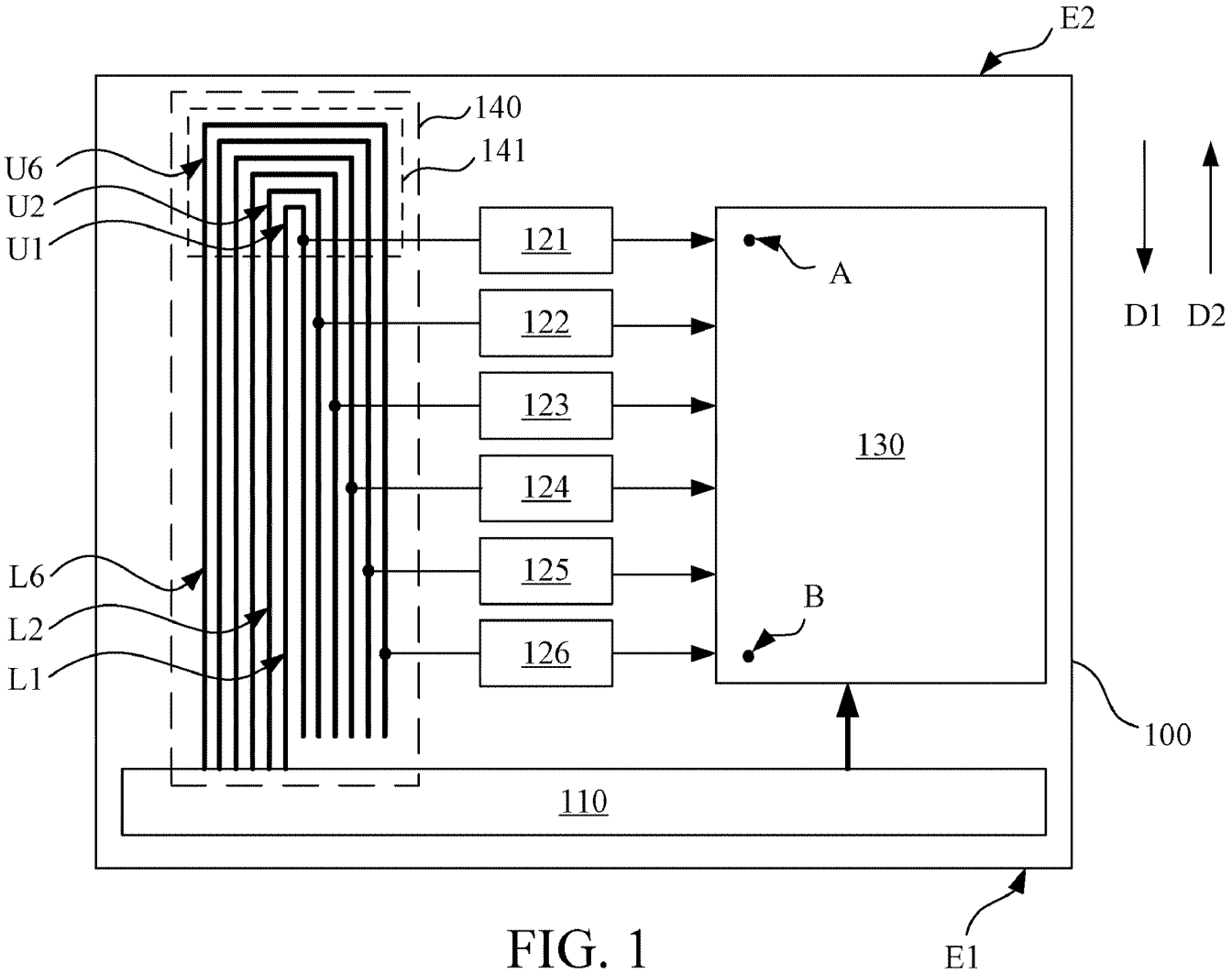
FIG. 1 is a schematic diagram of a display panel according to an embodiment of the present disclosure.

Referring to FIG. 1, FIG. 1 is a schematic diagram of a display panel 100 according to an embodiment of the present disclosure. The display panel 100 includes a signal generating circuit 110, a pixel array 130, and a plurality of gate driver circuits 121-126. The pixel array 130 is disposed adjacent to the signal generating circuit 110, and the gate driver circuits 121-126 are disposed adjacent to the signal generating circuit 110 and the pixel array 130.

The signal generating circuit 110 is configured to provide a plurality of clock signals and a plurality of data signals, and transfer the clock signals to the gate driver circuits 121-126. A gate driver circuit 120 is configured to convert the clock signals to a plurality of gate signals and transfer the gate signals to the pixel array 130. The pixel array 130 is configured to receive the gate signals and the data signals for display. It should be noted that due to a resistor-capacitor delay of a transfer path, waveforms of the gate signals and the data signals may be distorted as the transfer path increases. Delays of the gate signals increase along a first direction D1, delays of the data signals increase along a second direction D2, and the second direction D2 is opposite to the first direction D1. In other words, waveform distortion of the gate signals becomes severe along the first direction D1, and waveform distortion of the data signals becomes severe along the second direction D2 that is opposite to the first direction D1. Then, the signal generating circuit 110 is further configured to calibrate the gate signals and the data signals that delay along opposite directions, so as to avoid incorrect charging of the pixel array 130, and further improve the display effect.

Specifically, the gate driver circuits 121-126 include the gate driver circuit 121 and the gate driver circuit 122 that are arranged along the first direction D1. The clock signals include a first clock signal transferred to the gate driver circuit 121 and a second clock signal transferred to the gate driver circuit 122. It should be noted that a transfer path of the first clock signal is shorter than a transfer path of the second clock signal. Therefore, a delay of the second clock signal is severer than a delay of the first clock signal. With regard to a calibration method, the signal generating circuit 110 may output the clock signals in groups and at different times to the gate driver circuits 121-126, to calibrate the gate signals and the data signals.

In this way, the present disclosure may change directions along which the delays of the gate signals and the data signals increase (that is, directions along which the waveform distortion becomes severe). Therefore, the signal generating circuit 110 may further calibrate the gate signals and the data signals to improve the display effect of the display panel 100.

The following describes implementations of the gate signals and the data signals that delay along opposite directions. In an embodiment, as shown in FIG. 1, the display panel 100 further includes a plurality of bus lines 140 (for example, gate driver array high and low frequency lines), to transfer the clock signals from the signal generating circuit 110 to the gate driver circuits 121-126. Specifically, a bus line L1 is electrically coupled to the signal generating circuit 110 and the gate driver circuit 121, and a bus line L2 is electrically coupled to the signal generating circuit 110 and the gate driver circuit 122. The bus line L1 is configured to transfer the first clock signal to the gate driver circuit 121, and the bus line L2 is configured to transfer the second clock signal to the gate driver circuit 122. It should be noted that the total length of the bus line L1 is shorter than the total length of the bus line L2. Therefore, the delay of the second clock signal is severer than the delay of the first clock signal. By analogy, in FIG. 1, because the total length of a bus line L6 is the longest and the total length of the bus line L1 is the shortest, a transfer path of a clock signal transferred to the gate driver circuit 126 is the longest and a transfer path of a clock signal transferred to the gate driver circuit 121 is the shortest. As a result, in the clock signals transferred to the gate driver circuits 121-126, a delay of the clock signal transferred to the gate driver circuit 126 is the severest, and a delay of the clock signal transferred to the gate driver circuit 121 is the lightest. In other words, the delays of the clock signals increase along the first direction D1. Therefore, delays of the gate signals converted by the gate driver circuits 121-126 according to the clock signals also increase along the first direction D1.

In an embodiment, the bus lines 140 include U-shaped portions 141. Specifically, the bus line L1 includes a U-shaped portion U1, the bus line L2 includes a U-shaped portion U2, and the U-shaped portion U1 is disposed on an inner side of the U-shaped portion U2. Therefore, the total length of the bus line L1 is shorter than the total length of the bus line L2. By analogy, because a U-shaped portion U6 of the bus line L6 is disposed on the outermost side, and the U-shaped portion U1 of the bus line L1 is disposed on the innermost side, the total length of the bus line L6 (that is, a transfer path for transferring a sixth clock signal to the gate driver circuit 126) is the longest, and the total length of the bus line L1 (that is, the transfer path for transferring the first clock signal to the gate driver circuit 121) is the shortest.

With regard to a disposing manner of the U-shaped portions, for example, the signal generating circuit 110 is disposed along a first side edge E1 of the display panel 100, and the U-shaped portions 141 (including U-shaped portions U1, U2, and U6) are disposed close to a second side edge E2 of the display panel 100. The first side edge E1 is opposite to the second side edge E2. The first direction D1 and the second direction D2 are perpendicular to the first side edge E1 and the second side edge E2.

In this way, by means of arrangement of the bus lines 140 in the present disclosure, the delays of the gate signals increase along the first direction D1, and the delays of the data signals increase along the second direction D2 that is opposite to the first direction D1. Therefore, the gate signals and the data signals may be calibrated to improve the display effect of the display panel 100.

Figure 2:
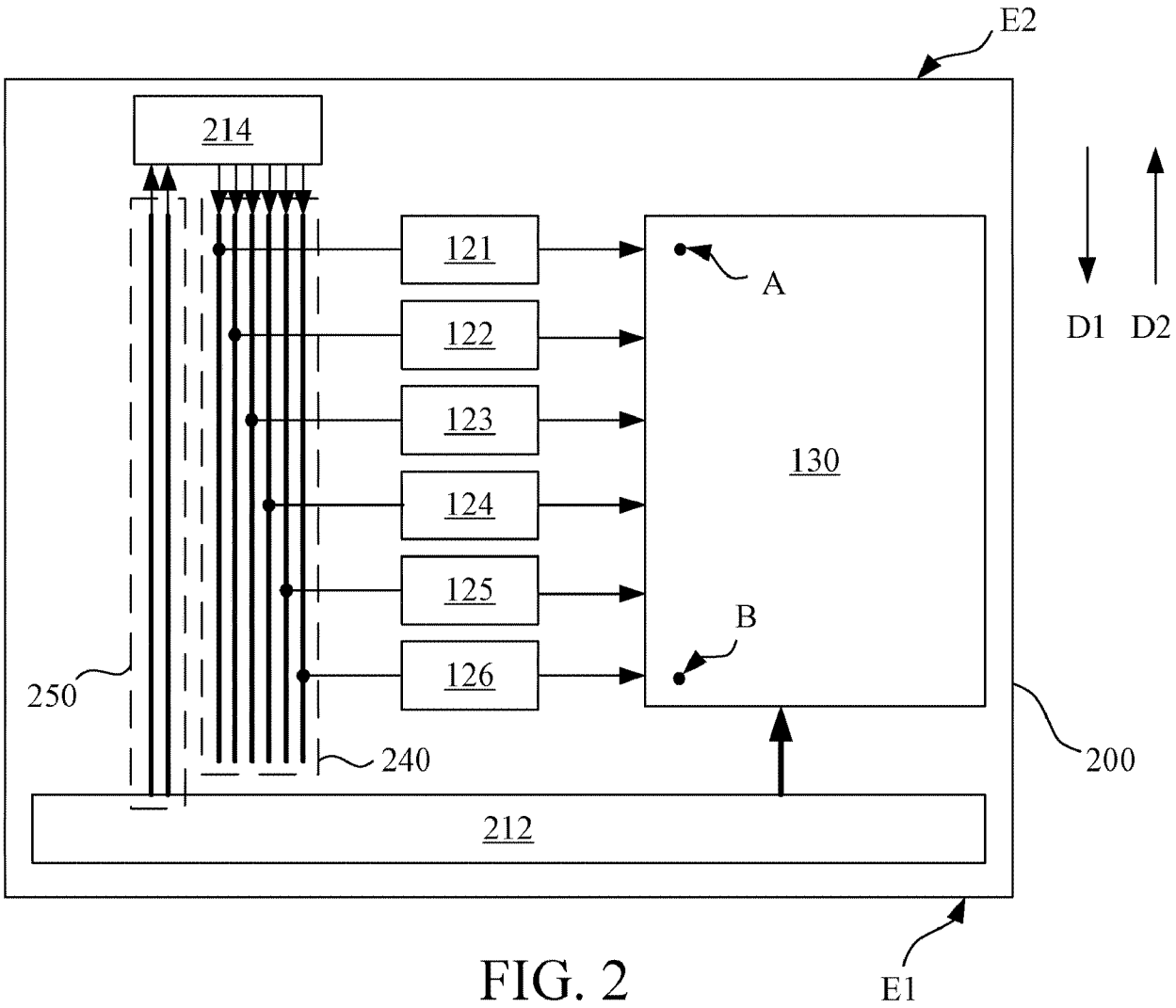
FIG. 2 is a schematic diagram of a display panel according to an embodiment of the present disclosure.

Alternatively, in another embodiment, as shown in FIG. 2, a signal generating circuit includes a data signal and direct current level generating circuit 212 and a clock signal generating circuit 214. The data signal and direct current level generating circuit 212 is disposed along a first side edge E1 of a display panel 200, and the clock signal generating circuit 214 is disposed along a second side edge E2 of the display panel 200.

The data signal and direct current level generating circuit 212 is configured to provide data signals to a pixel array 130, and provide a direct current level to the clock signal generating circuit 214 by using a line 250. The clock signal generating circuit 214 is configured to: receive the direct current level to generate clock signals, and transfer the clock signals to gate driver circuits 121-126 by using a plurality of bus lines 240. As described above, a transfer path of a first clock signal transferred to the gate driver circuit 121 is shorter than a transfer path of a second clock signal transferred to the gate driver circuit 122. Therefore, a delay of the second clock signal is severer than a delay of the first clock signal. By analogy, in FIG. 2, because a transfer path of a clock signal transferred to the gate driver circuit 126 is the longest and a transfer path of a clock signal transferred to the gate driver circuit 121 is the shortest, in the clock signals transferred to the gate driver circuits 121-126, a delay of the clock signal transferred to the gate driver circuit 126 is the severest, and a delay of the clock signal transferred to the gate driver circuit 121 is the lightest. In other words, delays of the clock signals increase along a first direction D1. Therefore, delays of gate signals converted by the gate driver circuits 121-126 according to the clock signals also increase along the first direction D1.

In this way, in the present disclosure, the clock signal generating circuit 214 disposed along the second side edge E2 of the display panel 200 provides the clock signals to the gate driver circuits 121-126, and the data signal and direct current level generating circuit 212 disposed along the first side edge E1 of the display panel 200 provides the data signals to the pixel array 130. Therefore, the gate signals and the data signals may be calibrated to improve the display effect of the display panel 200.

Figure 3:
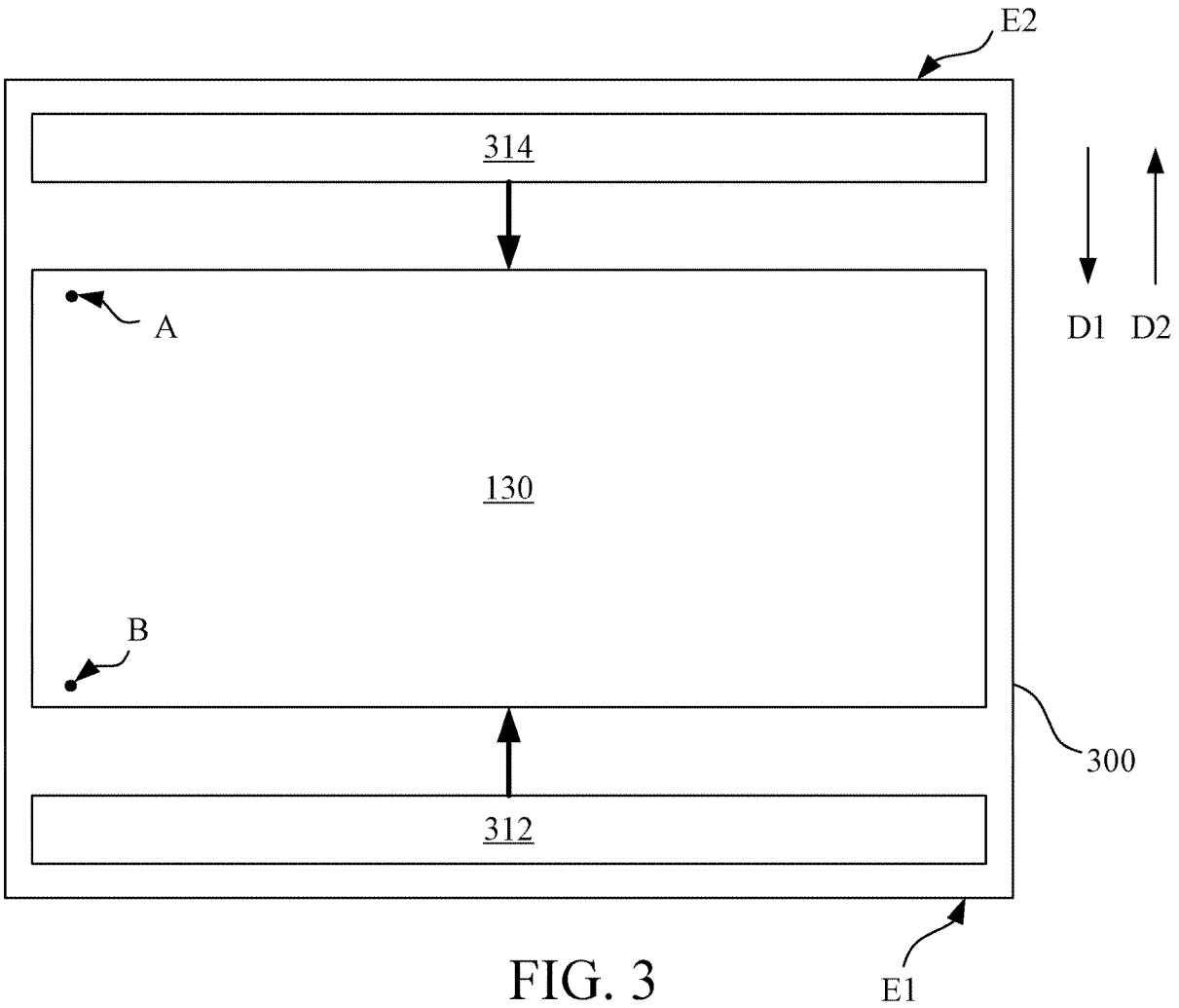
FIG. 3 is a schematic diagram of a display panel according to an embodiment of the present disclosure.
Figure 4A:
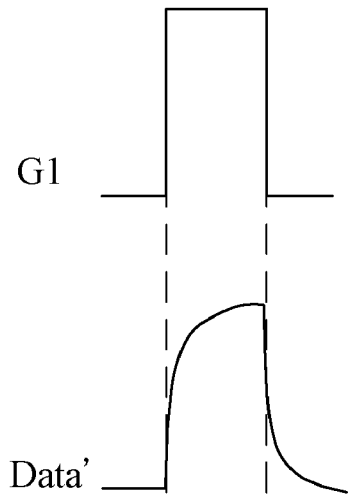
FIG. 4A is a schematic diagram of waveforms corresponding to a data signal and a gate signal in the display panel of FIG. 1 to FIG. 3 according to an embodiment of the present disclosure.
Figure 4B:
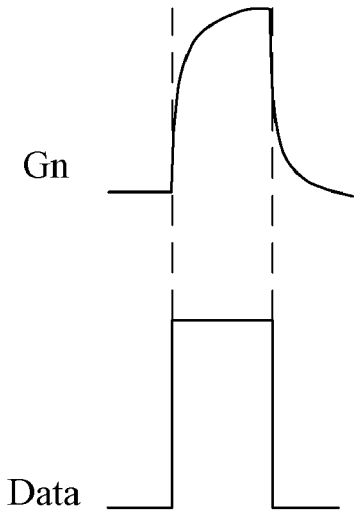
FIG. 4B is a schematic diagram of waveforms corresponding to a data signal and a gate signal in the display panel of FIG. 1 to FIG. 3 according to an embodiment of the present disclosure.

Alternatively, in another embodiment, a circuit generating data signals and a circuit generating gate signals may be disposed apart. Referring to FIG. 3, FIG. 3 is a schematic diagram of a display panel 300 according to an embodiment of the present disclosure. The display panel 300 includes a data signal generating circuit 312, a gate signal generating circuit 314, and a pixel array 130. The data signal generating circuit 312 is disposed along a first side edge E1 of the display panel 300, the gate signal generating circuit 314 is disposed along a second side edge E2 of the display panel 300, and the pixel array 130 is disposed between the data signal generating circuit 312 and the gate signal generating circuit 314.

The data signal generating circuit 312 disposed along the first side edge E1 is configured to provide a plurality of data signals to the pixel array 130. The gate signal generating circuit 314 disposed along the second side edge E2 is configured to provide a plurality of gate signals to the pixel array 130. The pixel array 130 is configured to receive the gate signals and the data signals for display. It should be noted that because the gate signal generating circuit 314 and the data signal generating circuit 312 respectively provide the gate signals and the data signals from opposite sides of the pixel array 130, delays of the gate signals increase along a first direction D1, and delays of the data signals increase along a second direction D2 that is opposite to the first direction D1. Then, the gate signal generating circuit 314 is further configured to calibrate the gate signals and the data signals, so as to avoid incorrect charging of the pixel array 130, and further improve the display effect. Specifically, the gate signal generating circuit 314 is further configured to output the gate signals in groups and at different times, so as to calibrate the gate signals and the data signals.

Refer to FIG. 1 to FIG. 3, FIG. 4A, and FIG. 4B for descriptions of a method for outputting the gate signals in groups and at different times by the signal generating circuit 110 and the gate signal generating circuit 314 to calibrate the gate signals and the data signals. As shown in FIG. 1 to FIG. 4A, at a point A in the pixel array 130, a waveform of a gate signal G1 approximates to a rectangular wave, and a waveform of a data signal Data' is distorted. Therefore, the signal generating circuit 110, the clock signal generating circuit 214, and the gate signal generating circuit 314 adjust a time sequence of the gate signal G1 to align the data signal Data', so as to avoid incorrect charging of the pixel array 130.

On the other hand, at a point B in the pixel array 130, a waveform of a data signal Data approximates to a rectangular wave, and a waveform of a gate signal Gn is distorted. Therefore, the signal generating circuit 110, the clock signal generating circuit 214, and the gate signal generating circuit 314 adjust a time sequence of the gate signal Gn to align the data signal Data, so as to avoid incorrect charging of the pixel array 130.

It should be noted that because delays of the gate signals and delays of the data signals increase along opposite directions (for example, the first direction D1 and the second direction D2), at least one of the gate signal and the data signal at each position in the pixel array 130 has a waveform that is not distorted (for example, approximating to a rectangular wave). Therefore, the gate signals and the data signals may be calibrated.

In some embodiments, the signal generating circuit 110, the data signal and direct current level generating circuit 212, the data signal generating circuit 312, and the gate signal generating circuit 314 may be implemented by using a printed circuit board assembly (PCBA), and the clock signal generating circuit 214 may be implemented by using a clock generator chip.

Based on the above, in the present disclosure, the delays of the gate signals and the delays of the data signals may be adjusted to increase along opposite directions (for example, the first direction D1 and the second direction D2). Therefore, the gate signals and the data signals may be calibrated.

Although the present invention has been disclosed above with the embodiments, the embodiments are not intended to limit the present invention. Any person skilled in the art may make various modifications and improvements without departing from the spirit and scope of the present invention. Therefore, the protection scope of the present invention shall be subject to the protection scope of the claims.

What is claimed is:

1. A display panel, comprising:

a signal generating circuit, configured to provide a plurality of clock signals and a plurality of data signals;

a pixel array, disposed adjacent to the signal generating circuit; and a plurality of gate driver circuits, disposed adjacent to the signal generating circuit and the pixel array, and configured to convert the clock signals to a plurality of gate signals and transfer the gate signals to the pixel array, wherein the pixel array is configured to receive the gate signals and the data signals for display, delays of the gate signals increase along a first direction, delays of the data signals increase along a second direction, the second direction is opposite to the first direction, and the signal generating circuit is further configured to calibrate the gate signals and the data signals.

2. The display panel according to claim 1, wherein the gate driver circuits comprise a first gate driver circuit and a second gate driver circuit that are arranged along the first direction, the clock signals comprise a first clock signal transferred to the first gate driver circuit and a second clock signal transferred to the second gate driver circuit, and a transfer path of the first clock signal is shorter than a transfer path of the second clock signal.

3. The display panel according to claim 2, wherein the display panel has a first side edge and a second side edge, the first side edge is opposite to the second side edge, the first direction and the second direction are perpendicular to the first side edge and the second side edge, and the signal generating circuit comprises:

a data signal and direct current level generating circuit, disposed along the first side edge, and configured to provide the data signals to the pixel array and provide a direct current level; and a clock signal generating circuit, disposed along the second side edge, and configured to: receive the direct current level to generate the clock signals, and transfer the clock signals to the gate driver circuits by using a plurality of bus lines.

4. The display panel according to claim 3, wherein the clock signal generating circuit is a clock generator chip.

5. The display panel according to claim 2, further comprising:

a first bus line, electrically coupled to the signal generating circuit and the first gate driver circuit, and configured to transfer the first clock signal to the first gate driver circuit; and a second bus line, electrically coupled to the signal generating circuit and the second gate driver circuit, and configured to transfer the second clock signal to the second gate driver circuit, wherein the total length of the first bus line is shorter than the total length of the second bus line.

6. The display panel according to claim 5, wherein the first bus line comprises a first U-shaped portion, the second bus line comprises a second U-shaped portion, and the first U-shaped portion is disposed on an inner side of the second U-shaped portion.

7. The display panel according to claim 6, wherein the display panel has a first side edge and a second side edge, the first side edge is opposite to the second side edge, the first direction and the second direction are perpendicular to the first side edge and the second side edge, the signal generating circuit is disposed along the first side edge, and the first U-shaped portion and the second U-shaped portion are disposed close to the second side edge.

8. The display panel according to claim 1, wherein the signal generating circuit is further configured to output the clock signals in groups and at different times to the gate driver circuits, so as to calibrate the gate signals and the data signals.

9. A display panel, having a first side edge and a second side edge, wherein the first side edge is opposite to the second side edge, and the display panel comprises:

a data signal generating circuit, disposed along the first side edge, and configured to provide a plurality of data signals;

a gate signal generating circuit, disposed along the second side edge, and configured to provide a plurality of gate signals; and a pixel array, disposed between the data signal generating circuit and the gate signal generating circuit, and configured to receive the gate signals and the data signals for display, wherein delays of the gate signals increase along a first direction, delays of the data signals increase along a second direction, the second direction is opposite to the first direction, the first direction and the second direction are perpendicular to the first side edge and the second side edge, and the gate signal generating circuit is further configured to calibrate the gate signals and the data signals.

10. The display panel according to claim 9, wherein the gate signal generating circuit is further configured to output the gate signals in groups and at different times, so as to calibrate the gate signals and the data signals.

* * * * *